US009544677B2

(12) United States Patent
Doerr et al.

(10) Patent No.: US 9,544,677 B2
(45) **Date of Patent: *Jan. 10, 2017**

(54) IN-EAR HEADPHONE

(71) Applicant: Klipsch Group, Inc., Indianapolis, IN (US)

(72) Inventors: Andrew Joshua Doerr, Indianapolis, IN (US); Thomas Edward Gospel, Carmel, IN (US); Brooke Lyn Hilsmeyer, Indianapolis, IN (US); Anthony Martin, Indianapolis, IN (US)

(73) Assignee: Klipsch Group, Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/202,004

(22) Filed: Mar. 10, 2014

(65) Prior Publication Data

US 2015/0256919 A1 Sep. 10, 2015

(51) Int. Cl.
*H04R 25/00* (2006.01)
*H04R 1/28* (2006.01)
*H04R 1/10* (2006.01)

(52) U.S. Cl.
CPC ..... *H04R 1/28* (2013.01); *H04R 1/1016* (2013.01)

(58) Field of Classification Search
CPC ..... H04R 1/1016; H04R 1/22
USPC ..... 381/328, 380, 74, 386
See application file for complete search history.

(56) References Cited

U.S. PATENT DOCUMENTS 6,683,965 B1 * 1/2004 Sapiejewski ..... 381/380
7,916,888 B2 3/2011 Sapiejewski et al.
D641,008 S 7/2011 Lee et al.
D646,262 S 10/2011 Chiu
8,107,665 B2 1/2012 Haapapuro et al.
8,238,596 B2 8/2012 Blanchard et al.
D674,373 S 1/2013 Combs et al.
8,391,535 B1 3/2013 Harvey et al.
8,594,351 B2 11/2013 Harlow et al.
8,666,085 B2 3/2014 Donaldson et al.
2008/0002835 A1 * 1/2008 Sapiejewski et al. ..... 381/71.6
(Continued)

FOREIGN PATENT DOCUMENTS

WO WO 2009/0239447 A1 1/2012

OTHER PUBLICATIONS

International Search Report & Written Opinion of the International Searching Authority, PCT/US15/19555—Related PCT Application of this pending application.

*Primary Examiner* — Curtis Kuntz
*Assistant Examiner* — Julie X Dang
(74) *Attorney, Agent, or Firm* — Indiano & McConnell LLC

(57) ABSTRACT

A pair of in-ear headphones is disclosed that are operable to reproduce incoming audio signals. The in-ear headphones include a housing defining an internal chamber. A front portion of the housing defines a nozzle extending away from the housing. A driver is positioned in the internal chamber such that a sound reproduction portion of the driver is aligned with an internal audio channel running through the nozzle. A damper is positioned in an end of the nozzle having a damper aperture having a predetermined size. The nozzle extends from a base portion of the housing at a predetermined upward angle and a predetermined bend angle that provides improved audio frequency responses in desirable frequency ranges.

23 Claims, 18 Drawing Sheets

(56) References Cited

U.S. PATENT DOCUMENTS

| | | | | |
|---|---|---|---|---|
| 2009/0147981 | A1* | 6/2009 | Blanchard et al. | 381/380 |
| 2009/0285436 | A1* | 11/2009 | Lowry | 381/380 |
| 2011/0103637 | A1* | 5/2011 | Yuen | H04R 1/1041<br>381/380 |

* cited by examiner

IN-EAR HEADPHONE

Headphones are generally understood to be a pair of small loudspeakers that are designed to be placed next to a user's ears so that a user can listen to audio transmissions. Alternative versions of headphones that are worn in-ear are often referred to as earbuds or earphones. Earbuds either have wires for connection to a signal source or have a wireless device that is configured to receive signals from a signal source. Earbuds are very small headphones that fit directly into the outer ear. Earbuds typically face the ear canal but are not directly inserted into the ear canal. They provide little acoustic isolation and allow ambient noise to be heard by a user. In-ear headphones are small headphones that are inserted directly into the ear canal of the user. Because in-ear headphones engage the ear canal, they are less prone to falling out and block out much of the ambient noise that surrounds a user thereby providing higher quality sound reproduction.

DETAILED DESCRIPTION

Figure 1:
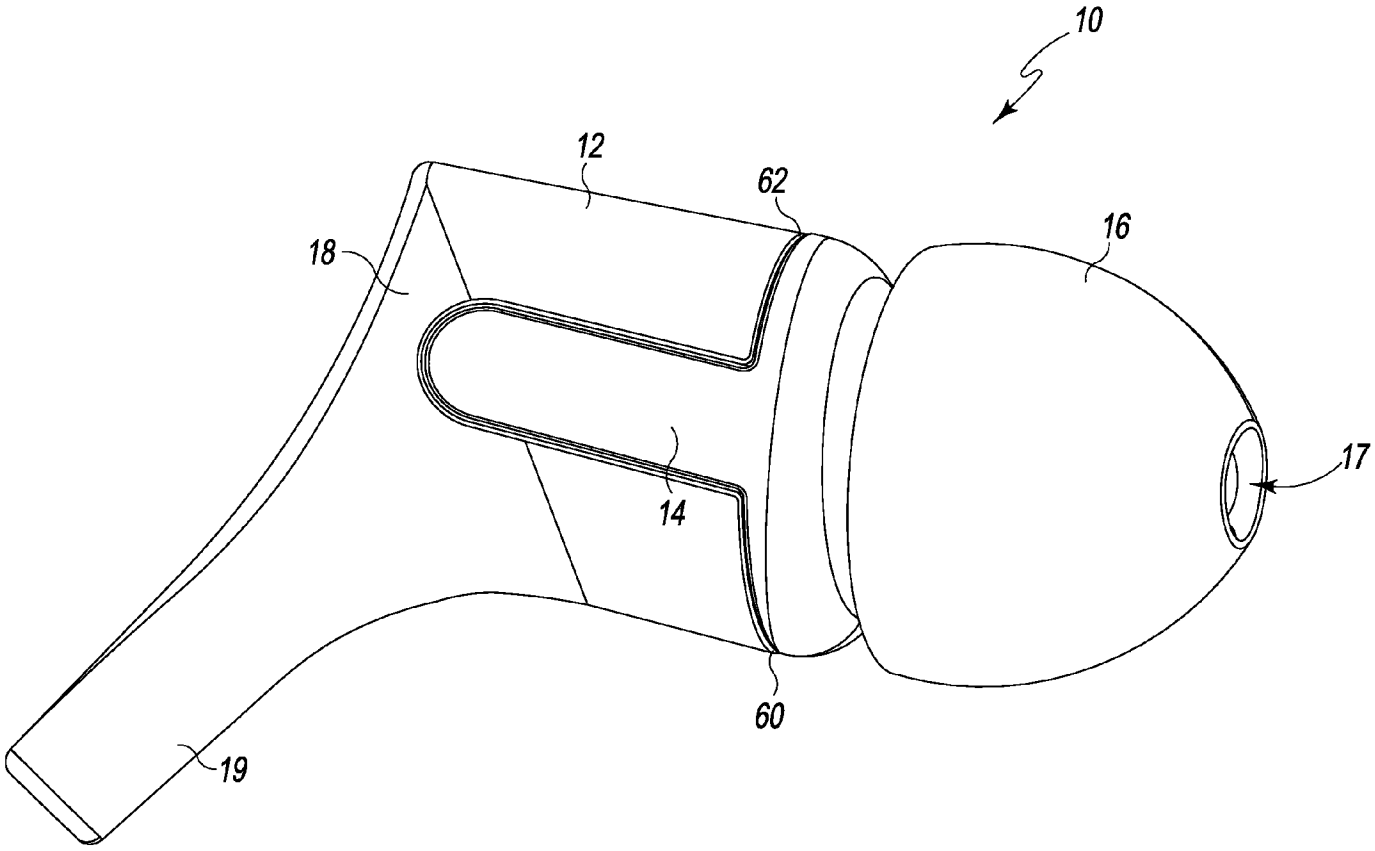
FIG. 1 illustrates a representative in-ear headphone.
Figure 2:
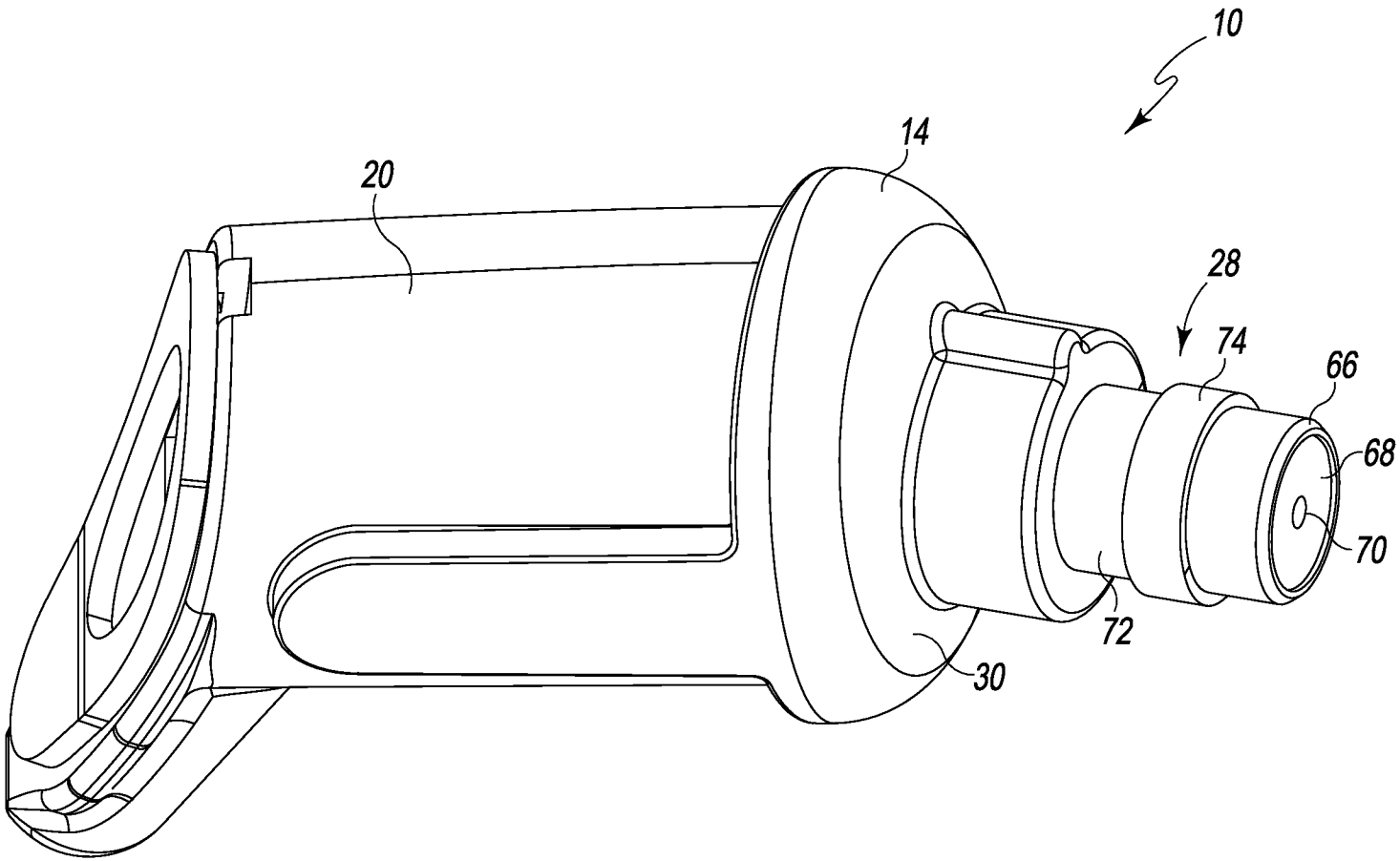
FIG. 2 illustrates a view of the in-ear headphone depicted in FIG. 1 with an outer housing and eartip removed.

Referring to FIG. 1, an in-ear headphone 10 is illustrated that includes a co-molded rear housing 12, a front housing 14, and an eartip 16. The co-molded rear housing 12 and front housing 14 have an oval shape along a vertical axis through the housings 12, 14. In the illustrated form, the eartip 16 comprises an oval-shaped eartip 16 having an aperture 17 in and end thereof so that sound waves can travel out of the in-ear headphone 10 and into the ear canal of a user. In one form, the co-molded rear housing 12 is connected with the front housing 14 using a friction fit. The co-molded rear housing 12 could also be connected with the front housing 14 using an adhesive. Referring collectively to FIGS. 1 and 2, the co-molded rear housing 12 comprises an outer housing 18 and an inner housing 20. In FIG. 2, the outer housing 18 has been removed from the inner housing 20. In one form, the outer housing 18 is connected with the inner housing 20 using a friction fit. The outer housing 18 could also be connected with the inner housing 20 using an adhesive. In the illustrated form, the outer housing 18 includes a downwardly extending extension 19 located at the rear of the outer housing 18 that is configured to receive an electrical conductor or wire.

Figure 3:
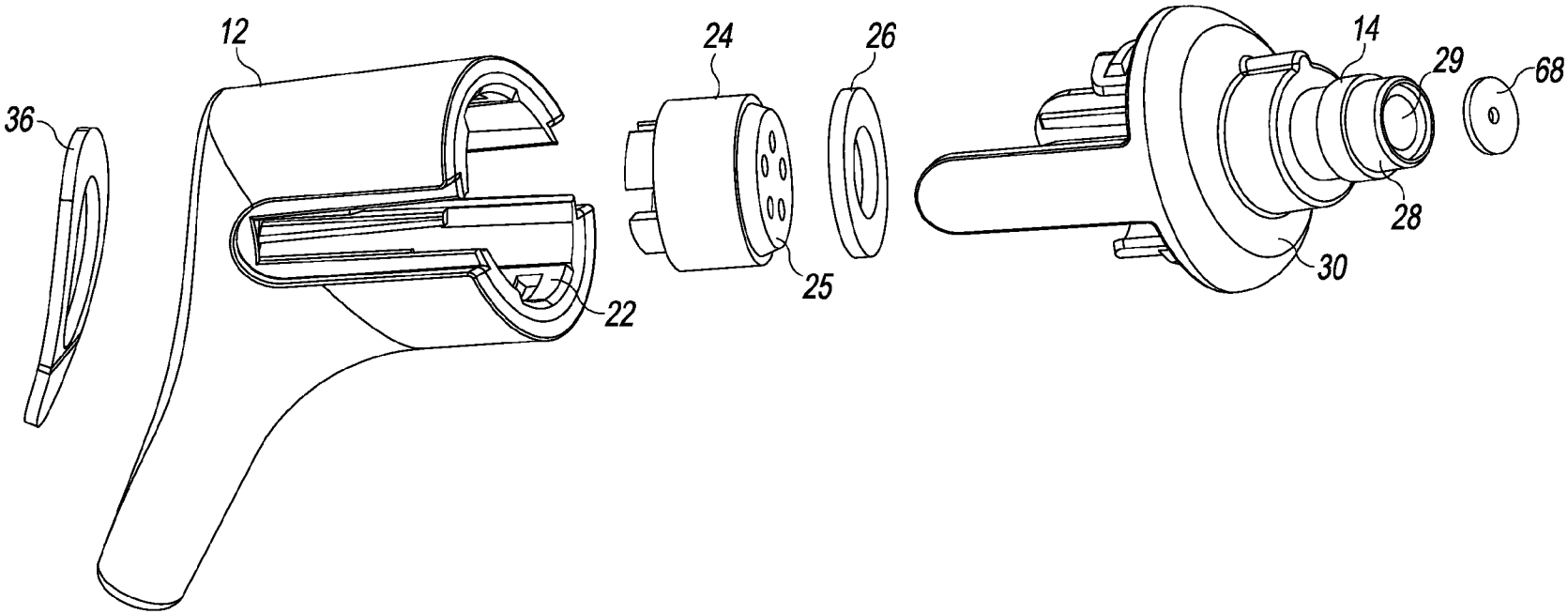
FIG. 3 illustrates a component view of the in-ear headphone depicted in FIG. 1.
Figure 4:
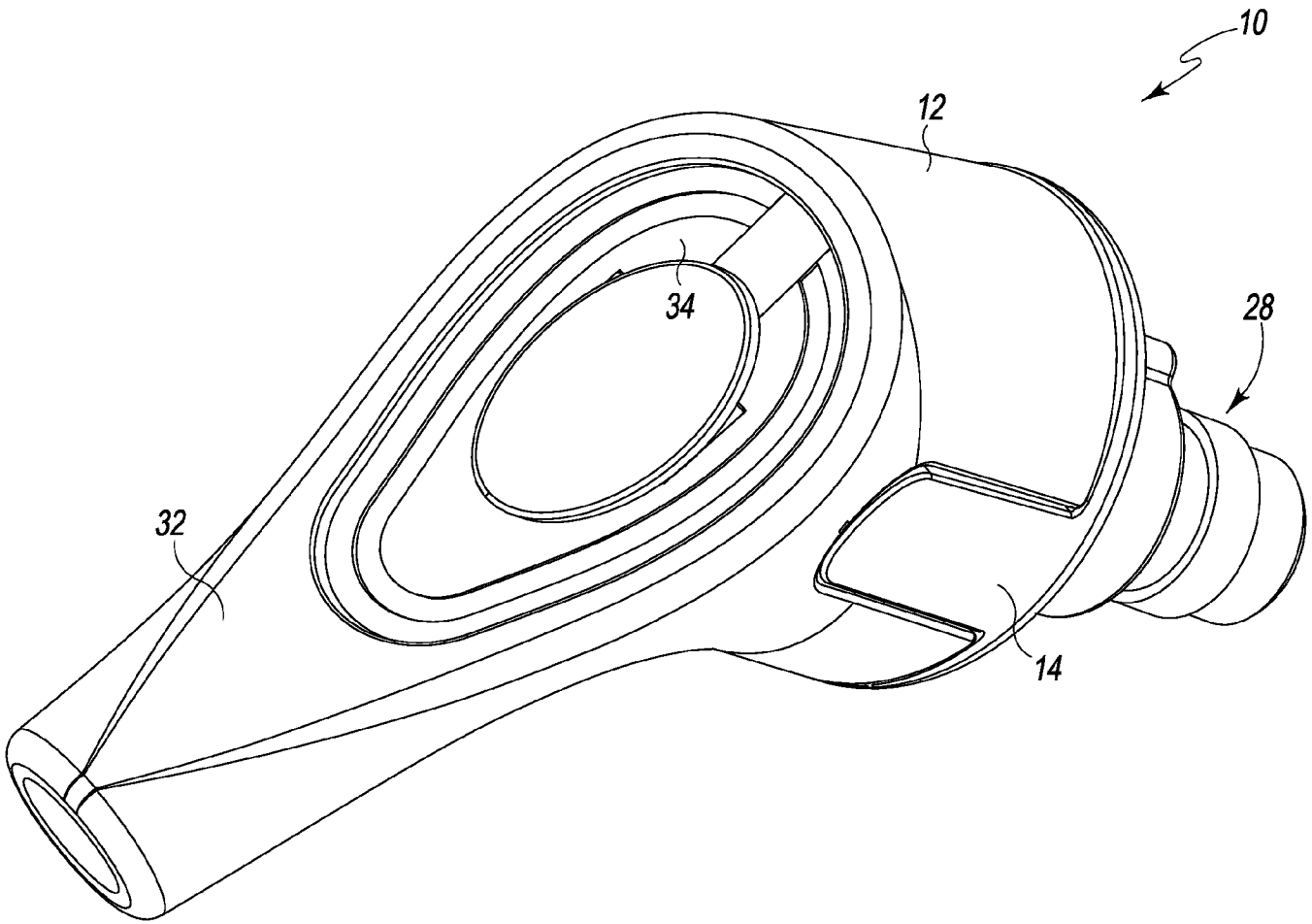
FIG. 4 illustrates a rear view of the in-ear headphone depicted in FIG. 1.

Referring to FIG. 3, an exploded component view of the in-ear headphone 10 is depicted. As illustrated, the in-ear headphone 10 includes the co-molded rear housing 12 and the front housing 14. Housed within an interior chamber 22 defined by the co-molded rear housing 12 and front housing 14 is a driver 24 and a driver gasket 26. The driver 24 is used to reproduce sound and in one form, comprises a 6.5 mm moving-coil driver. The front housing 14 includes a nozzle 28 that extends outwardly from a base portion 30 of the front housing 14. When assembled, a sound reproduction portion 25 of the driver 24 is aligned with an internal audio channel 29 defined by the nozzle 28. During operation, the sound reproduction portion 25 of the driver 24 directs sound waves through the internal audio channel 29 where the sound waves then pass through a damper 68 and out of the in-ear headphones 10 to the ear canal of a user. Referring collectively to FIGS. 3 and 4, a back portion 32 of the outer rear housing 18 includes a recession 34. A decorative plate 36 fits within the recession 34 in the back portion 32 of the outer rear housing 18.

Figure 5:
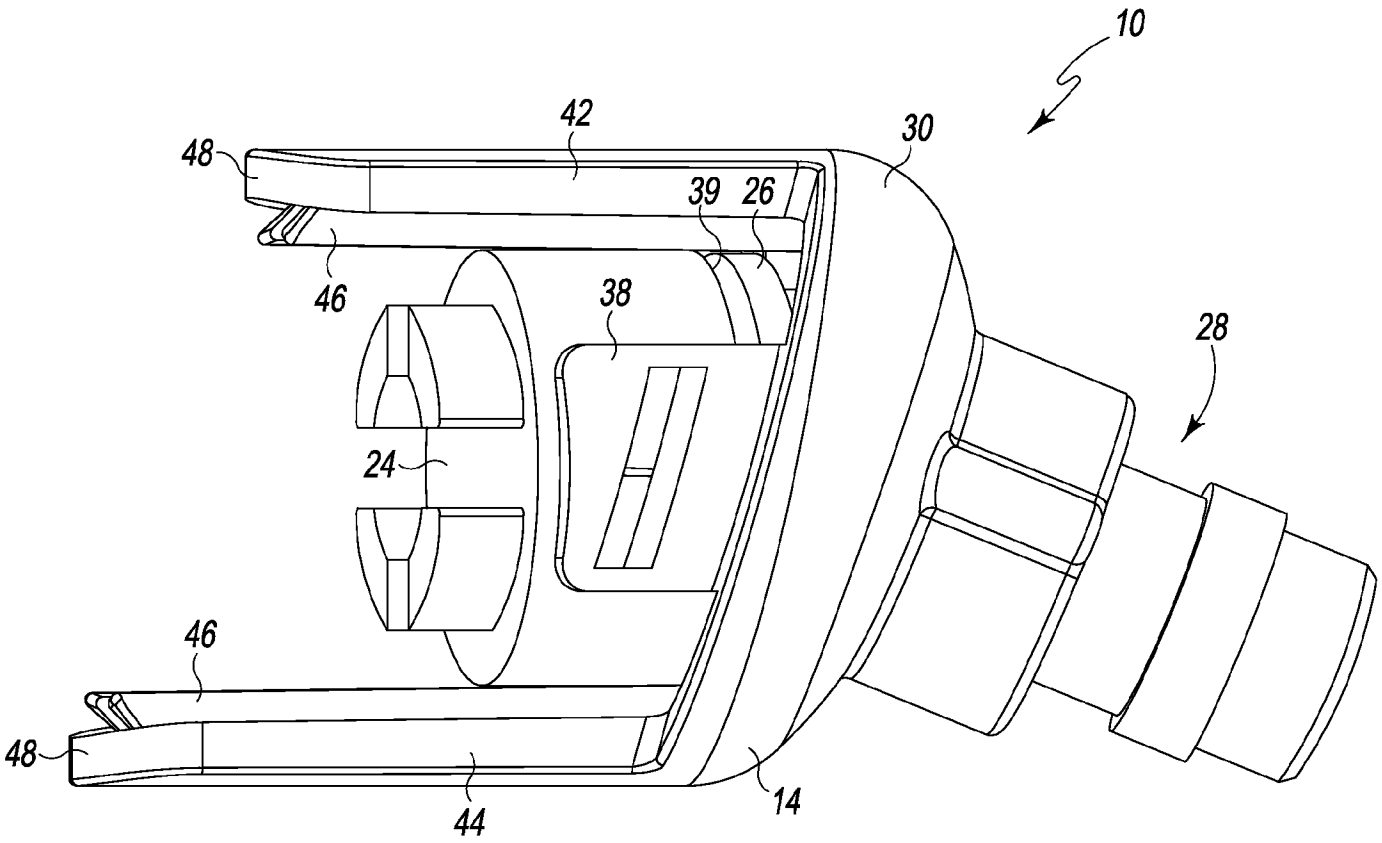
FIG. 5 illustrates a top view of a front housing and driver of the in-ear headphone depicted in FIG. 1.
Figure 6:
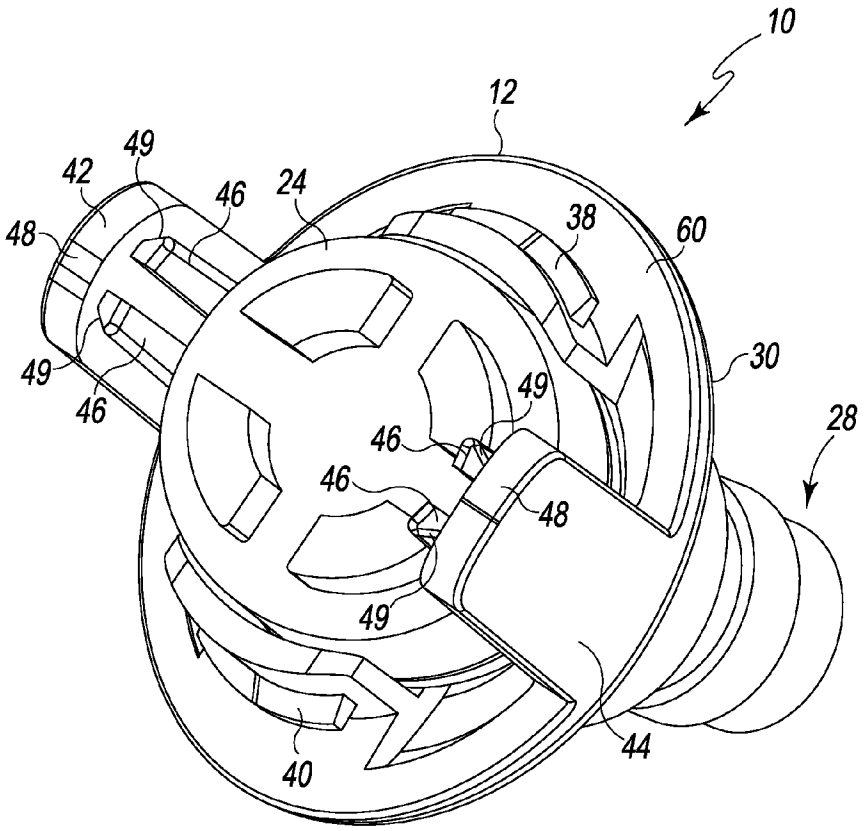
FIG. 6 illustrates a rear view of the front housing and driver depicted in FIG. 5.
Figure 7:
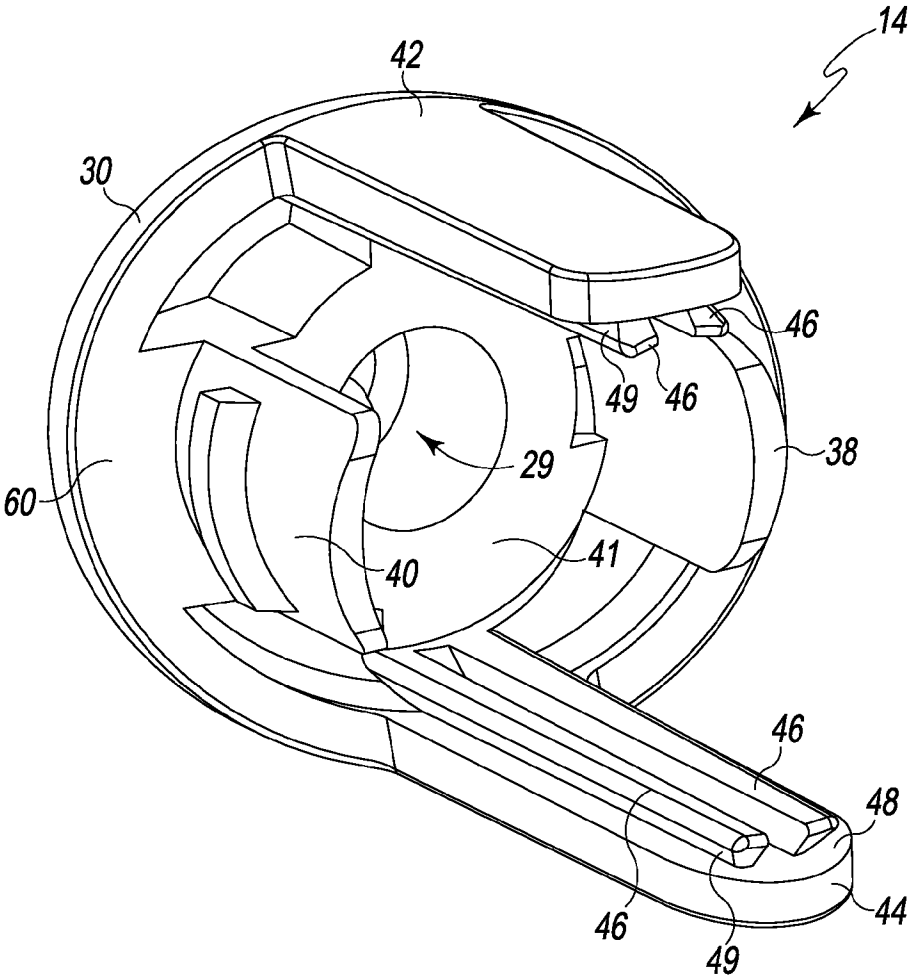
FIG. 7 illustrates another rear view of the front housing depicted in FIG. 5 with the driver removed.

Referring collectively to FIGS. 5 and 6, the front housing 14 is depicted with the driver 24 secured thereto. As illustrated, the base portion 30 of the front housing 14 includes a first driver support bracket 38 and a second driver support bracket 40. As illustrated, the first and second driver support brackets 38, 40 extend outwardly from the base portion 30. The base portion 30 has a generally cylindrical shape and the driver support brackets 38, 40 also have a generally cylindrical shape. In the illustrated form, the driver support brackets 38, 40 are oriented on opposite sides from one another on the base portion 30. The driver 24 also has a generally cylindrical shape and is friction fit and connected with the driver support brackets 38, 40 thereby securing the driver 24 in place in the front housing 14. As illustrated, the driver 24 is positioned between the driver support brackets 38, 40. As illustrated in FIGS. 5 and 7, the driver gasket 26 is positioned between a front surface 39 of the driver 24 and an interior surface 41 of the base portion 30 of the front housing 14.

The front housing 12 also includes a first arm 42 and a second arm 44 that extend outwardly from the base portion 30. As illustrated, the first arm 42 is shorter in length than the second arm 44 and the first and second arms 42, 44 are disposed on opposite sides from one another. An interior portion or surface of the first and second arms 42, 44 include one or more rails 46 that extend outwardly from the base portion 30 toward an end 48 of the first and second arms 42, 44. The rails 46 include inwardly tapering portions 49 to help secure the front housing 14 to the rear housing 12.

Figure 8:
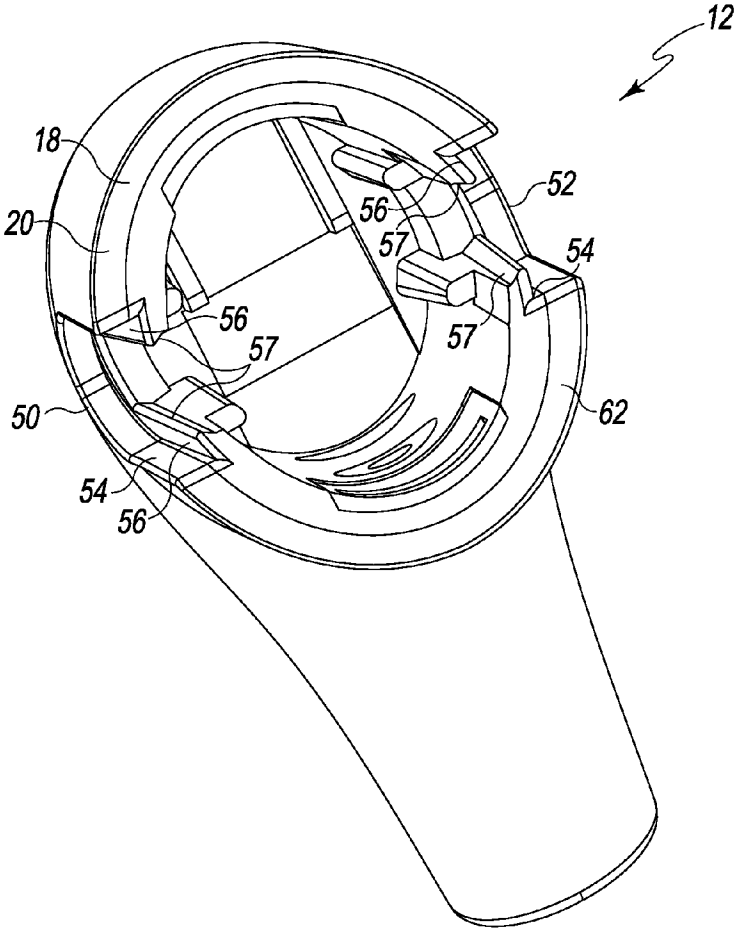
FIG. 8 illustrates a front perspective view of the rear housing of the in-ear headphone depicted in FIG. 1.
Figure 9:
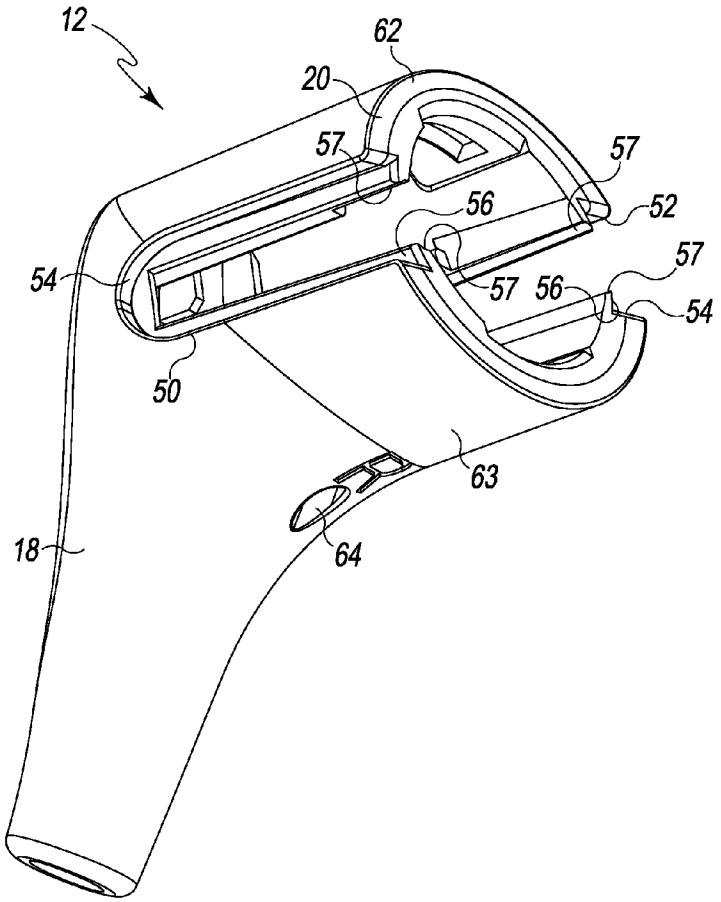
FIG. 9 illustrates a side perspective view of the rear housing of the in-ear headphone depicted in FIG. 1.

Referring to FIGS. 8 and 9, the outer housing 18 includes a first U-shaped slot 50 and a second U-shaped slot 52 that oppose one another. The inner housing 20 includes a pair of opposing U-shaped recessed slots 54 that define a pair of L-shaped interior walls 56. The interior walls 56 in each recessed slot 54 extend toward one another thereby defining a track in each respective U-shaped recessed slot 54. Each interior wall 56 includes an inwardly tapering portion 57 on one leg of the L-shaped interior walls 56 that is sized and configured to accept the inwardly tapering portions 49 of the rails 46 located on the opposing arms 42, 44 of the front housing 14. As such, the inwardly tapering portions 49 of the rails 46 of the arms 42, 44 are secured within the inwardly tapering portions 57 of the U-shaped recessed slots 54 to secure the first housing 12 to the second housing 14. Thus, a locking mechanism is thereby created in which the arms 42, 44 slide into the U-shaped slots 50, 52 of the outer housing 18 and the rails 46 lock or secure the front housing 14 in place in the rear housing 12 by using the tapered portions 49 of the rails 46 to mate with the tapered portions 57 of the interior walls 56 defined by the U-shaped recessed slots 54.

Referring collectively to FIGS. 1 and 5-9, when assembled the first and second arms 42, 44 are inserted into the U-shaped slots 50, 52 defined by the outer housing 18 of the rear housing 12. The rails 46 of the first and second arms 42, 44 fit between the interior wall 56 defined by the inner housing 20 of the rear housing 12. As depicted in FIG. 1, an interior surface 60 of the base portion 30 defined by the front housing 14 is placed against an outer end surface 62 defined by the rear housing 12.

Referring to FIG. 9, an underneath portion 63 of the rear housing 12 includes an aperture or vent 64 that extends into the interior chamber 22 defined by the rear housing 12. In this form, the vent 64 extends through both the outer housing 18 and inner housing 20. The vent 64 allows ambient air to enter the interior chamber 22. The vent 64 allows the in-ear headphone 10 to have enhanced bass frequency responses during operation thereby improving the quality of sound reproduced by the in-ear headphone 10. In one form, the vent 64 has a diameter of about 1.0 millimeter. In other forms, the vent 64 could have a diameter in the range of about 0.5 millimeters to 2.0 millimeters.

Referring back to FIG. 2, the front housing 14 includes a base portion 30 that includes a nozzle 28 extending outwardly from the base portion 30. Positioned within an end or end portion 66 of the nozzle 28 is a damper 68. As will be discussed in greater detail below, the damper 68 includes an aperture or hole 70 having a predefined diameter. In one form, the hole 70 has a diameter of about 0.6 millimeters and the damper 68 is made from polyethylene terephthalate ("PET"). In other forms, the hole 70 has a diameter in the range of about 0.4-0.8 millimeters. A central portion 72 of the nozzle 28 has a band 74 having a larger diameter than the rest of the nozzle 28 that helps secure the eartip 16 to the nozzle 28.

Figure 10:
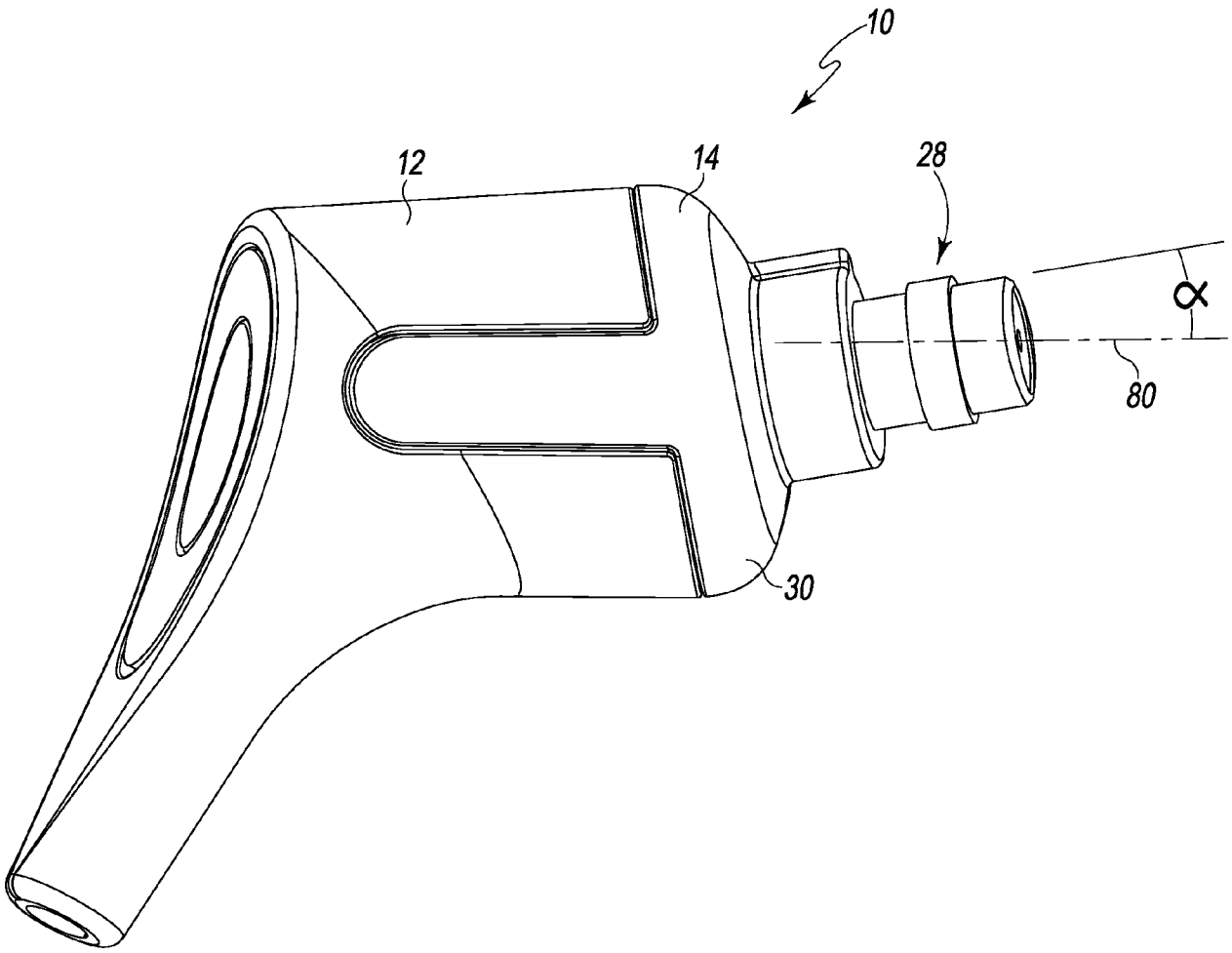
FIG. 10 illustrates a side view of the in-ear headphone.
Figure 11:
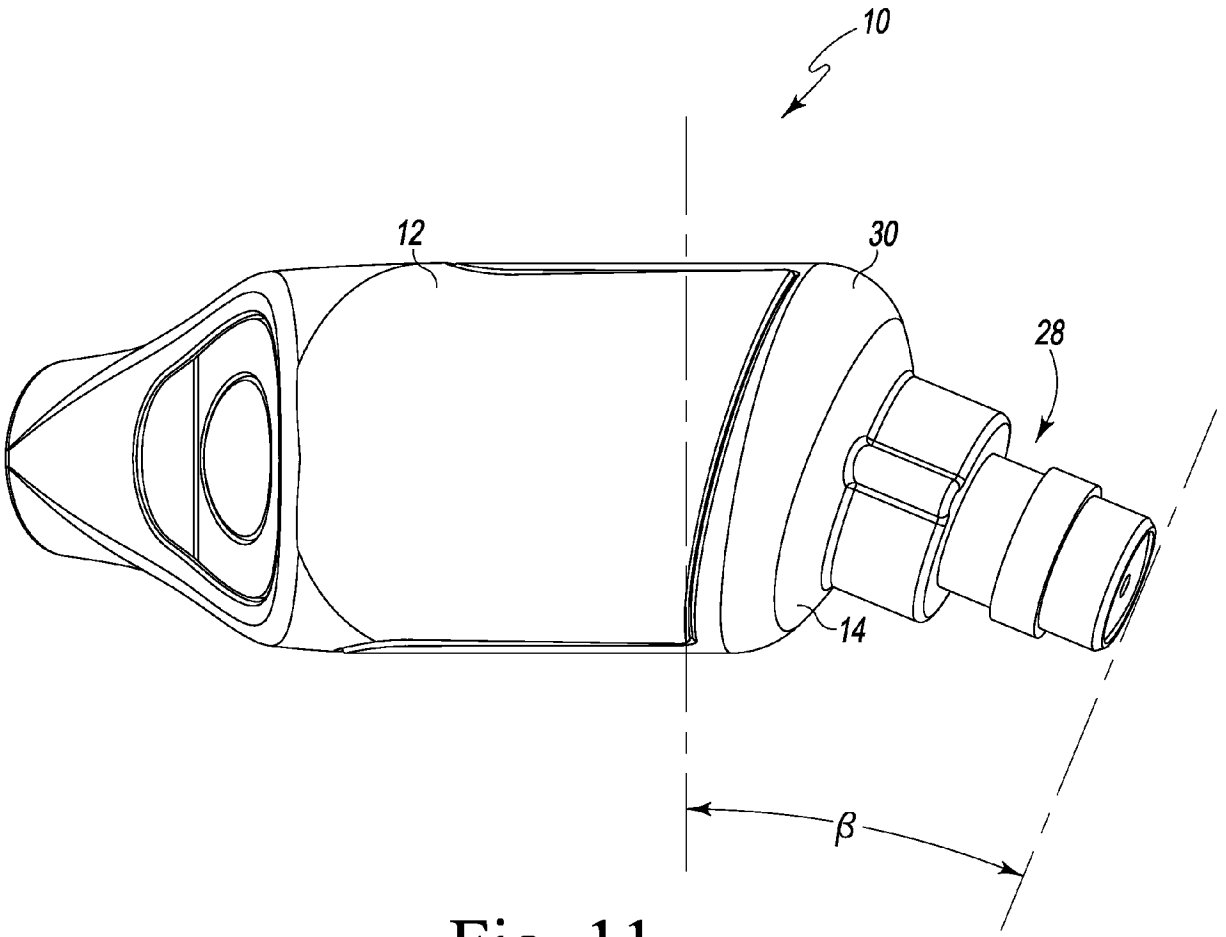
FIG. 11 illustrates a top view of a right in-ear headphone.

Referring to FIG. 10, a front side view of the in-ear headphone 10 is illustrated with the eartip 16 removed. As depicted, the nozzle 28 is oriented in relation to a horizontal axis of the rear housing 12 and a portion of the base portion 30 of the front housing 14 to have a predetermined upward or vertical angle $\alpha$. In one form, the upward angle $\alpha$ is about 10.0°. In another form, the upward angle $\alpha$ could have a range from about 8-12°. Referring to FIG. 11, a top view of the in-ear headphone 10 is illustrated with the eartip 16 removed. As depicted, the nozzle 28 is oriented in relation to a vertical axis of the rear housing 12 and a portion of the base portion 30 of the front housing 14 to have a predetermined bend angle $\beta$. In one form, the predetermined bend angle $\beta$ is about 22.0°. In another form, the bend angle $\beta$ could have a range from about 15-30°.

Figure 12:
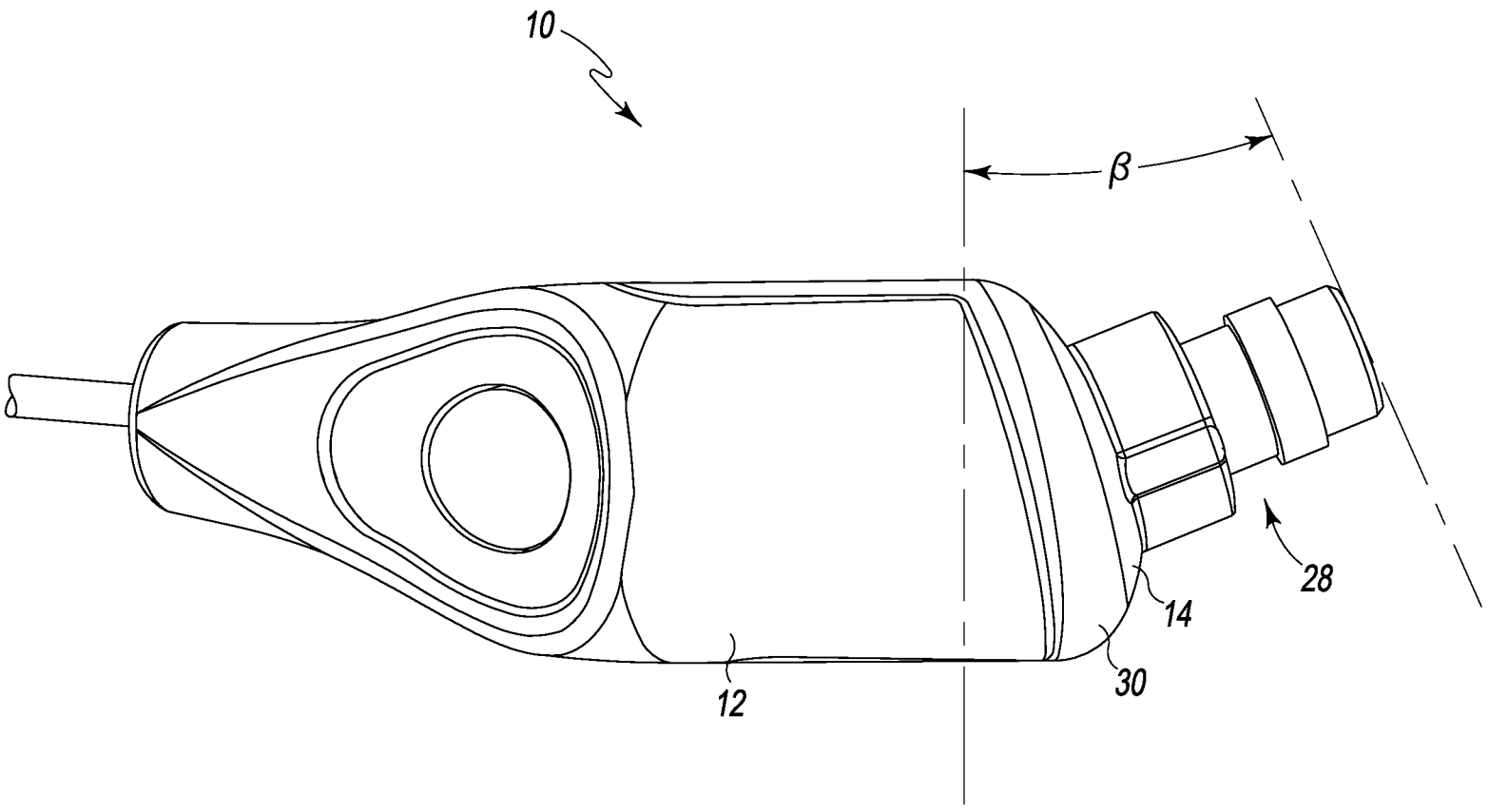
FIG. 12 illustrates a top view of a left in-ear headphone.

The in-ear headphone 10 illustrated in FIG. 11 is the right in-ear headphone 10, and in this instance the predetermined bend angle $\beta$ is a downward bend angle $\beta$. Referring to FIG. 12, the left in-ear headphone 10 is illustrated, and in this instance the predetermined bend angle $\beta$ is an upward bend angle $\beta$. Thus, the in-ear headphones 10 disclosed herein have an upward angle $\alpha$ and a bend angle $\beta$. Originally, the upward and bend angles were included to more conform to the outer and inner ear of a user from a comfort and fit perspective. However, as set forth in detail below, it was discovered that the upward and bend angles also provided unexpected results in improving the acoustic performance of the in-ear headphones 10 disclosed herein.

Figure 13:
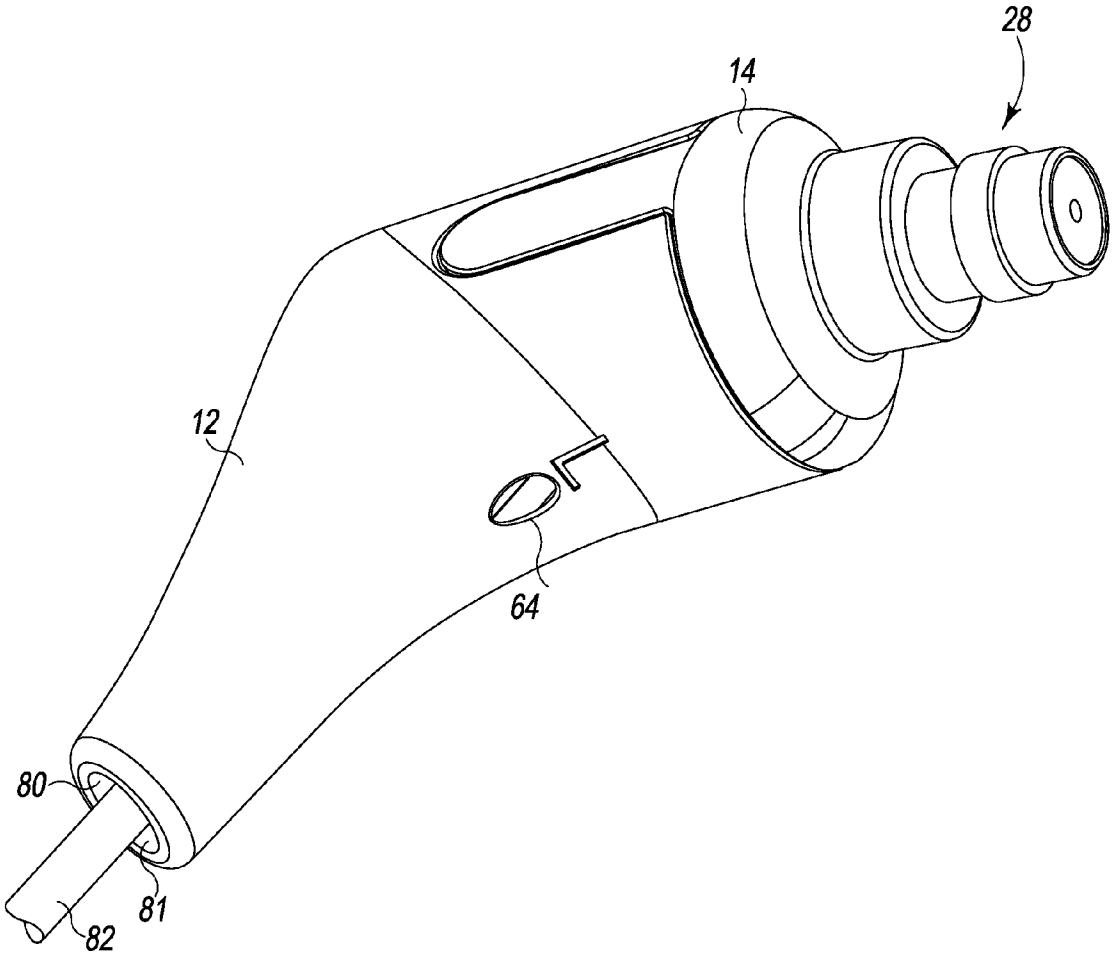
FIG. 13 illustrates a bottom view of the left in-ear headphone.
Figure 14:
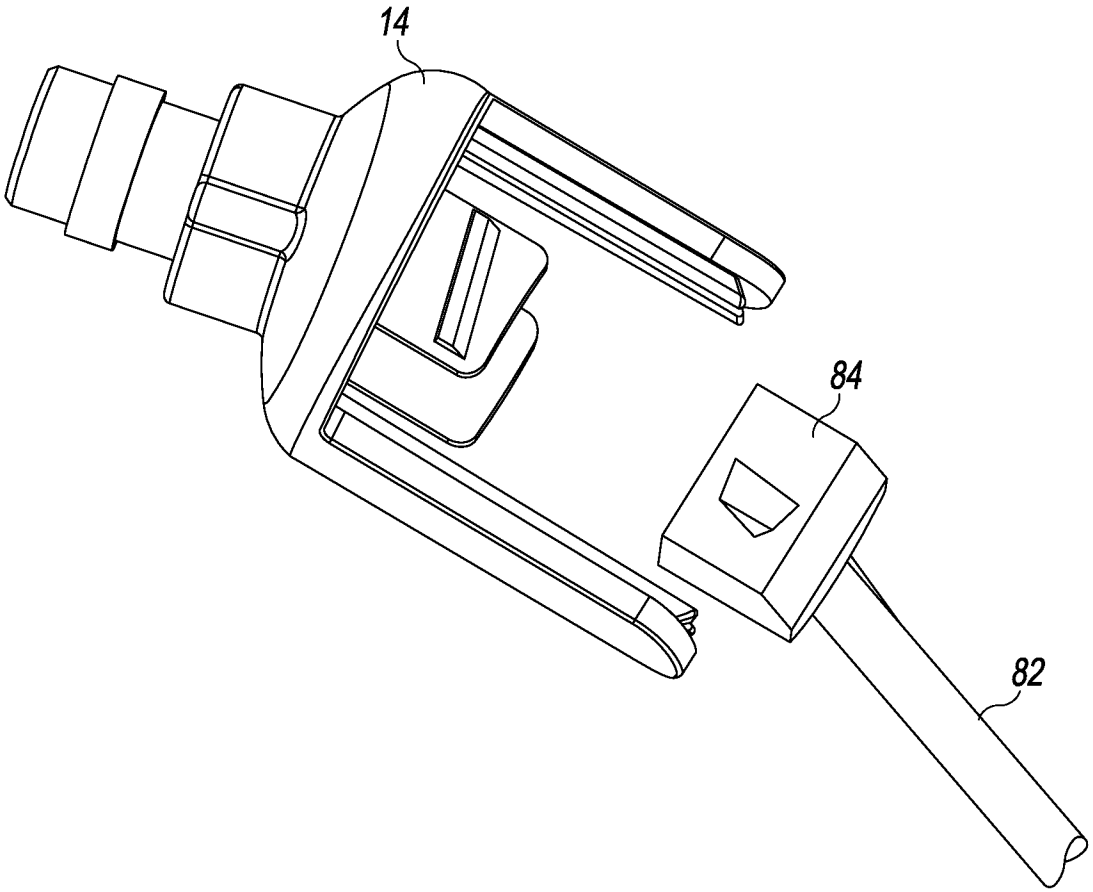
FIG. 14 illustrates a top view of the front housing and respective electrical components of the in-ear headphone.

Referring to FIG. 13, a lower portion 80 of the rear housing 12 includes an aperture 81 sized and configured to receive a conductive wire 82 that is used to transmit electric signals to the driver 28. As illustrated in FIG. 14, the conductive wire 82 runs through the aperture 81 to an electrical connector 84 contained within the interior chamber 22 defined by the rear housing 12. The output of the electrical connector 84 is then connected with the driver 28 thereby providing electric signals to the driver 28 during use of the in-ear headphone 10.

Figure 15:
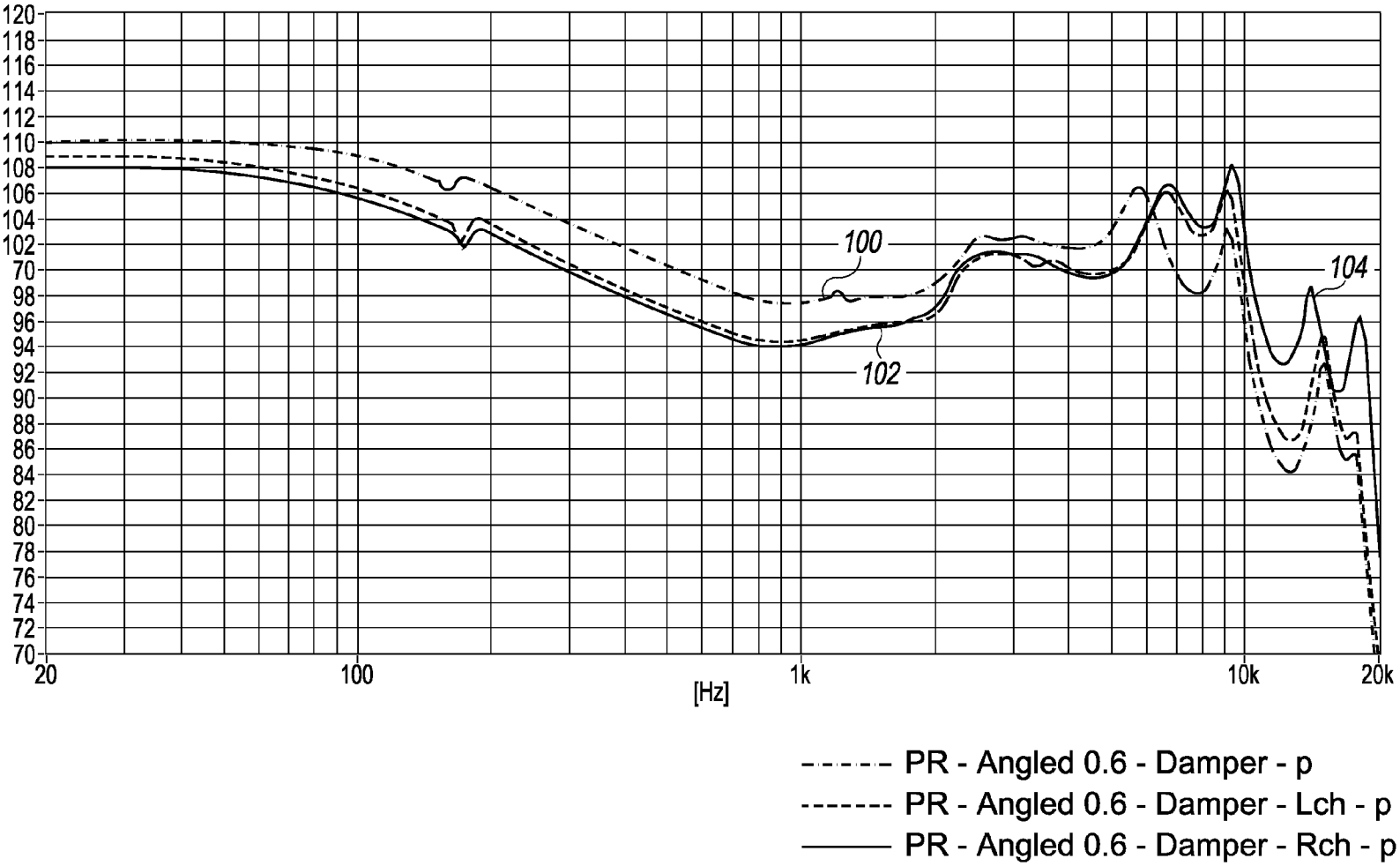
FIG. 15 illustrates a frequency response curve showing frequency responses for an angled in-ear headphone and straight in-ear headphones having a damper with a hole having a diameter of about 0.6 millimeters.

Referring to FIG. 15, a frequency response curve is illustrated having a frequency range of 20 Hz to 20 kHz on the horizontal axis and a sound pressure level reading in decibels (dB) ranging from 70 dB to 120 dB on the vertical axis. The frequency response curve was created by sweeping a constant-amplitude pure tone through the bandwidth range depicted on the horizontal axis and measuring the resulting sound pressure levels generated by the respective in-ear headphones being analyzed. In FIG. 15, the in-ear headphone 10 disclosed and claimed herein was first tested and the resulting output is represented at 100 in FIG. 15. Thus, the in-ear headphone tested in this form had an upward angle $\alpha$ of 10.0°, a bend angle $\beta$ of 22.0° and a damper having a 0.6 millimeter hole (hereinafter the "angled nozzle"). Next, two separate in-ear headphones were tested that did not include an upward angle $\alpha$ or a bend angle $\beta$. The nozzle 28 was a straight nozzle and had a damper with a 0.6 millimeter hole (hereinafter the "straight nozzle"). The test results for the two straight nozzle in-ear headphones are labeled 102, 104 respectively. As illustrated, the straight nozzle version had a considerably weaker response from about 100 Hz to 2 kHz than the angled nozzle version. Further, the straight nozzle version had a much brighter response from about 6 k to 10 k than the angled nozzle version, which is undesirable. As such, the angled nozzle version of the in-ear headphones 10 outperformed the straight nozzle version from an acoustic sound quality standpoint and a comfort and fit standpoint.

Figure 16:
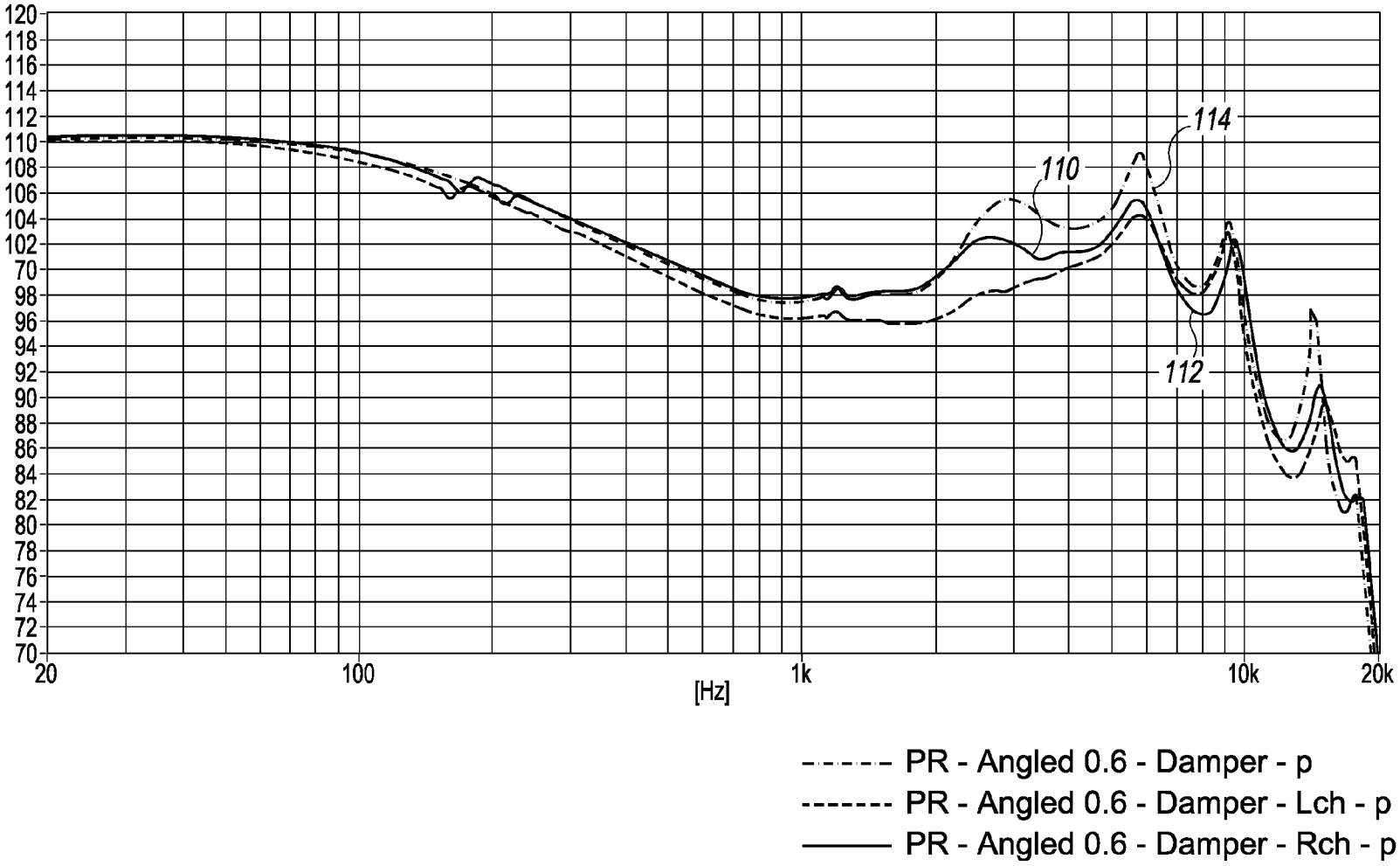
FIG. 16 illustrates a frequency response curve showing frequency responses for an angled in-ear headphone having no damper, a full damper, and a damper having a hole having a diameter of about 0.6 millimeters.

Referring to FIG. 16, another set of tests was conducted in which frequency response curves were generated for the angled nozzle versions of the in-ear headphones 10 having a 0.6 millimeter hole in the damper 28, no hole in the damper 28, and no damper 28. The in-ear headphone 10 having a 0.6 millimeter hole in the damper is illustrated at 110, no hole in the damper 28 is illustrated at 112, and no damper 28 at all is illustrated at 114. As illustrated, the in-ear headphone with no damper was too "bright" (i.e.—very high notes) from about 2.3 kHz to 6 kHz, which is undesirable. The in-ear headphone with the damper 28 having a 0.6 millimeter hole was relatively smooth from about 2.3 kHz to 6 khz, which is desirable. The in-ear headphone with a full damper 28 having no hole was too "muddy" or didn't have enough "presence" from about 1 kHz to 4 kHz, which is also undesirable. As such, once again, the angled version of the in-ear headphones 10 disclosed herein having a damper 28 with a 0.6 millimeter hole outperformed other versions of in-ear headphones.

Figure 17:
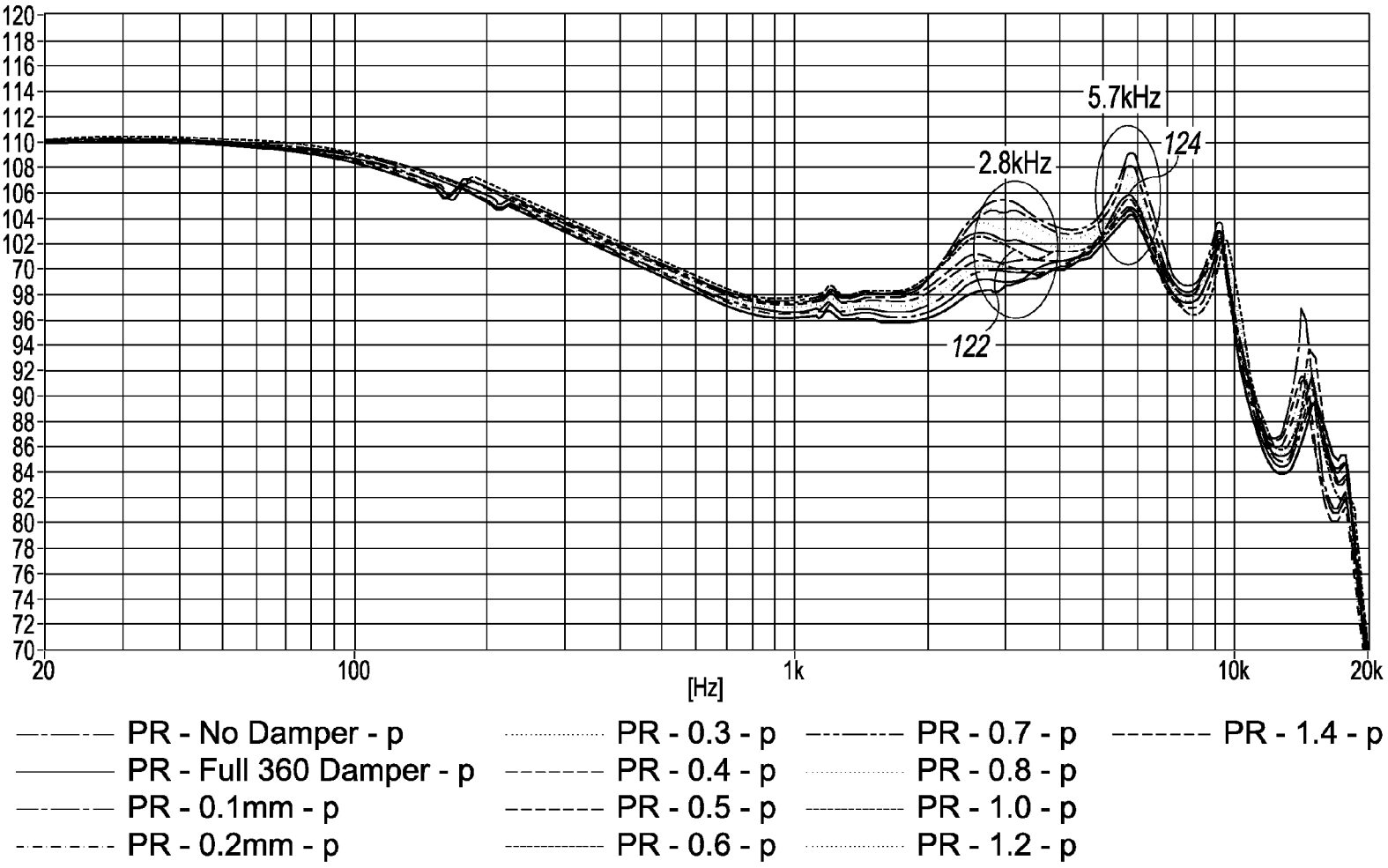
FIG. 17 illustrates a frequency response curve showing frequency responses for an angled in-ear headphone having no damper, a full damper, and dampers having holes ranging from about 0.1 millimeters to 1.4 millimeters.

Referring to FIG. 17, frequency response curves were generated for various other in-ear headphone design variations. These frequency response curves were generated to show the effects of various different damper designs. In particular, frequency response curves were generated for in-ear headphones designed as disclosed herein having no damper 28, a full damper 28 (with no hole), and then in-ear headphones having dampers 28 having holes in the following diameters 0.1 millimeters, 0.2 millimeters, 0.3 millimeters, 0.4 millimeters, 0.5 millimeters, 0.6 millimeters, 0.7 millimeters, 0.8 millimeters, 1.0 millimeters, 1.2 millimeters, and 1.4 millimeters. As illustrated, the in-ear headphone 10 having a damper 28 with a 0.6 millimeter hole outperformed all of these other design variations. This version's frequency response curve is labeled at 122 and 124 in FIG. 17. Other variations were either too high or muddy in the frequency ranges of about 2 kHz to 4 kHz and 5 kHz to 7 kHz. The optimal curve, the one that was most balanced, is represented by the angled nozzle version of the in-ear headphone 10 with a damper 28 having a 0.6 millimeter hole.

Figure 18:
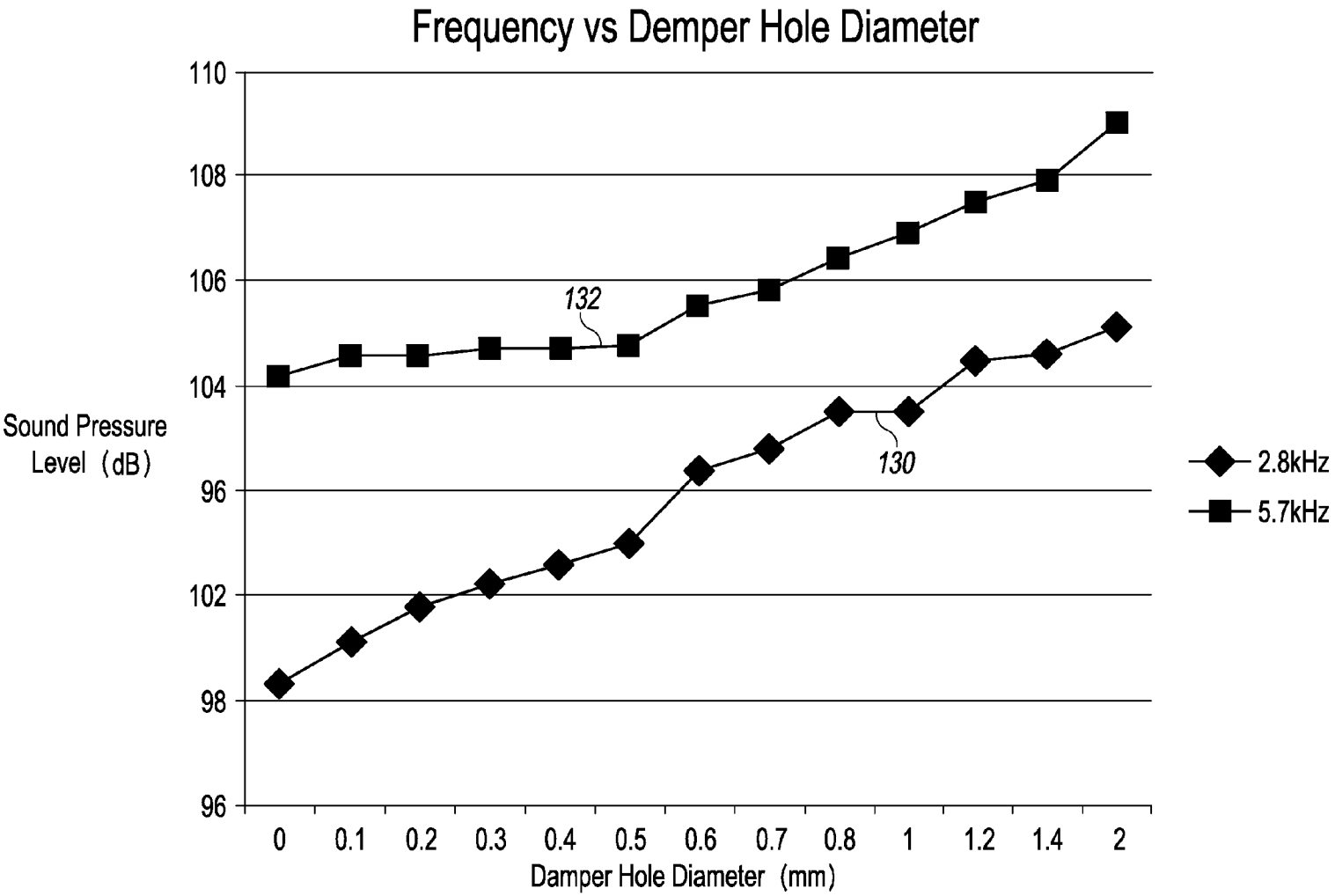
FIG. 18 is a graph showing sound pressure levels for different respective damper hole sizes for two frequencies.

Referring to FIG. 18, a graph is provided that discloses sound pressure level values in the vertical axis compared to damper hole size in the horizontal axis. Frequency responses were charted for a 2.8 kHz signal and a 5.7 kHz signal for various damper hole sizes. The frequency responses for the 2.8 kHz signal is labeled 130 and the frequency response for the 5.7 kHz signal is labeled 132. The table below lists the results:

| Hole Size (mm) | 2.8 kHz Value (dB) | 5.7 kHz Value (dB) |
|---|---|---|
| 0 | 98.3 | 104.2 |
| 0.1 | 99.1 | 104.6 |
| 0.2 | 99.8 | 104.6 |
| 0.3 | 100.2 | 104.7 |
| 0.4 | 100.6 | 104.8 |
| 0.5 | 101 | 104.8 |
| 0.6 | 102.4 | 105.5 |
| 0.7 | 102.8 | 105.8 |
| 0.8 | 103.5 | 106.4 |
| 1.0 | 103.5 | 106.9 |
| 1.2 | 104.5 | 107.5 |
| 1.4 | 104.6 | 107.9 |
| 2.0 | 105.1 | 109 |

As set forth in the chart above and illustrated in FIG. 18, damper hole sizes between 0.6-0.8 millimeters resulted in the most increase of the 2.8 kHz peak and the least increase of the 5.8 kHz peak. As previously set forth, the more balanced the frequency response is across the entire audible human hearing spectrum the higher the quality of sound reproduction the in-ear headphone is capable of providing. It has been found with respect to the in-ear headphone 10 disclosed herein that a damper hole 70 that is sized at about 0.6 millimeters produces the desired results across this audible spectrum.

While the use of words such as preferable, preferably, preferred or more preferred utilized in the description indicate that the feature so described may be more desirable, such feature(s) may not be necessary. Embodiments lacking the same are within the scope of the invention as defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An in-ear headphone, comprising:

a housing defining an internal chamber, wherein a front portion of said housing defines a nozzle extending away from said housing having an internal audio channel;

a driver positioned in said internal chamber such that a sound reproduction portion of said driver is aligned with said internal audio channel running through said nozzle;

a damper positioned in an end of the nozzle having a damper aperture having a predetermined diameter; and wherein said nozzle extends from said front portion of said housing at a predetermined upward angle in relation to a horizontal axis of said oval shaped housing and a predetermined bend angle in relation to a vertical axis of said oval shaped housing.

2. The in-ear headphone of claim 1, wherein said housing comprises a front housing connected with a rear housing, wherein said front housing includes said front portion and said nozzle.

3. The in-ear headphone of claim 2, wherein said rear housing comprises an outer housing and an inner housing, wherein said outer housing includes a pair of opposing slots and said inner housing includes a pair of opposing recessed slots aligned with said pair of opposing slots in said outer housing, wherein said pair of opposing recessed slots define a pair of interior walls extending toward one another that define a track in each of said opposing recessed slots.

4. The in-ear headphone of claim 3, wherein said front housing includes a pair of opposing arms extending away from said front portion of said front housing, wherein an interior surface of said opposing arms includes at least one rail protruding upwardly from said interior surface, wherein said pair of said opposing arms are positioned in said pair of opposing slots of said outer housing and said pair of rails are positioned in a respective track of said pair of opposing recessed slots.

5. The in-ear headphone of claim 1, further comprising a vent located on a lower surface of said housing in communication with said internal chamber.

6. The in-ear headphone of claim 5, wherein said vent has a diameter of about 1 millimeter.

7. The in-ear headphone of claim 1, wherein said predetermined diameter of said damper aperture is about 0.6 millimeters.

8. The in-ear headphone of claim 1, wherein said predetermined upward angle is about 10.0°.

9. The in-ear headphone of claim 1, wherein said predetermined bend angle is about 22.0°.

10. The in-ear headphone of claim 1, wherein said predetermined diameter of said damper aperture is about 0.6 millimeters, said predetermined upward angle is about 10.0°, and said predetermined bend angle is about 22.0°.

11. The in-ear headphone of claim 10, further comprising a vent located on a lower surface of said housing in communication with said internal chamber, wherein said vent has a diameter of about 1 millimeter.

12. The in-ear headphone of claim 1, wherein said predetermined diameter of said damper aperture is within a range of about 0.4 millimeters to 0.8 millimeters.

13. The in-ear headphone of claim 1, wherein said predetermined upward angle is within a range of about 8-12°.

14. The in-ear headphone of claim 1, wherein said predetermined bend angle is within a range of about 15-30°.

15. An in-ear headphone, comprising:

a rear housing defining an internal chamber;

a front housing connected with said rear housing, wherein said front housing includes a base portion, wherein a nozzle extends outwardly and away from said base portion, wherein said nozzle includes an internal audio channel, wherein said nozzle has a predetermined upward angle in relation to a horizontal axis of said rear housing and a predetermined bend angle in relation to a vertical axis of said rear housing;

a driver connected with a rear portion of said base portion of said front housing such that a sound reproduction portion of said driver is aligned with said internal audio channel of said nozzle, wherein a portion of said driver is positioned in said internal chamber and said rear portion of said front housing; and a damper positioned in an end of said nozzle having a damper aperture having a predetermined diameter.

16. The in-ear headphone of claim 15, further comprising a gasket positioned between said rear portion of said base portion and said sound reproduction portion of said driver.

17. The in-ear headphone of claim 15, wherein said predetermined upward angle is about 10.0°.

18. The in-ear headphone of claim 15, wherein said predetermined bend angle is about 22.0°.

19. The in-ear headphone of claim 15, wherein said predetermined diameter of said damper aperture is about 0.6 millimeters.

20. An in-ear headphone, comprising:

a rear housing defining an internal chamber, wherein said rear housing comprises an outer housing secured over an inner housing, wherein said outer housing includes a pair of opposing slots, wherein said inner housing includes a pair of opposing recessed slots aligned with said opposing pair of slots in said outer housing, wherein said pair of opposing recessed slots define a track;

a front housing having a base portion, wherein a pair of opposing arms extend from said base portion, wherein said pair of opposing arms are sized and configured to be secured within said pair of opposing slots in said outer housing, wherein an interior surface of each of said opposing arms includes at least one rail, wherein each said rails is oriented in a respective track to secure said front housing with said rear housing;

a driver positioned in said internal chamber, wherein a front portion of said driver is positioned between a pair of opposing driver support brackets extending rearward from said base portion of said front housing;

a nozzle extending forward and away from said base portion of said front housing that includes an internal audio channel running therethrough, wherein an inlet to said internal audio channel is aligned with a sound reproduction portion of said driver, wherein said nozzle extends forward and away from said base portion at a predetermined upward angle in relation to a horizontal axis of said base portion and a predetermined bend angle in relation to a vertical axis of said base portion; and a damper positioned in an end of said nozzle, wherein said damper includes a damper aperture having a predetermined diameter.

21. The in-ear headphone of claim 20, wherein said predetermined upward angle is about 10.0°.

22. The in-ear headphone of claim 20, wherein said predetermined bend angle is about 22.0°.

23. The in-ear headphone of claim 20, wherein said predetermined diameter of said damper aperture is about 0.6 millimeters.

* * * * *